US009228358B2

(12) United States Patent
Hornung

(10) Patent No.: US 9,228,358 B2
(45) Date of Patent: Jan. 5, 2016

(54) SELF-SUPPORTING ARTICULATED-ARM CASSETTE AWNING FOR VEHICLES

(71) Applicant: Dometic WAECO International GmbH, Emsdetten (DE)

(72) Inventor: Dirk Hornung, Emsdetten (DE)

(73) Assignee: DOMETIC WAECO INTERNATIONAL GMBH (SE)

( * ) Notice: Subject to any disclaimer, the term of this patent is extended or adjusted under 35 U.S.C. 154(b) by 0 days.

(21) Appl. No.: 14/138,578

(22) Filed: Dec. 23, 2013

(65) Prior Publication Data

US 2014/0182792 A1 Jul. 3, 2014

(30) Foreign Application Priority Data

Dec. 24, 2012 (DE) ..... 20 2012 012 282 U

(51) Int. Cl.
*E04F 10/06* (2006.01)

(52) U.S. Cl.
CPC ..... *E04F 10/0618* (2013.01); *E04F 10/0637* (2013.01); *E04F 10/0688* (2013.01)

(58) Field of Classification Search
CPC ..... E04F 10/00; E04F 10/06; E04F 10/0618; E04F 10/0637; E04F 10/0688
USPC ..... 160/66, 67, 70, 79
See application file for complete search history.

(56) References Cited

U.S. PATENT DOCUMENTS 1,811,907 A * 6/1931 Anton ..... 248/278.1
2,123,828 A * 7/1938 Gibson ..... 403/73
2,823,885 A * 2/1958 D Azzo ..... 248/278.1
5,232,036 A * 8/1993 Brutsaert ..... 160/70

(Continued)

FOREIGN PATENT DOCUMENTS

EP 1215348 6/2002
EP 1760221 A2 * 3/2007 ..... E04F 10/06
EP 1760221 3/2012

*Primary Examiner* — Katherine Mitchell
*Assistant Examiner* — Abe Massad
(74) *Attorney, Agent, or Firm* — Middleton Reutlinger

(57) ABSTRACT

The invention relates to a self-supporting articulated-arm cassette awning, in particular for motor homes or trailers, comprising articulated arms (20) that are pivotable at awning arm joints or shoulder joints (10), and brackets or shoulders (II) for connecting the entire awning (100) to the vehicle by means of fastening elements and for receiving joint pins (I) in an insertable, in particular, slidable manner and for at least limiting the twistability of joint pins (I) of those parts of the awning arm joint or shoulder joint that are fixed to the vehicle. Desirable is a compact, continuously variable twisting arrangement for the joint pin which, at the same time, is capable of absorbing the high torques of the extended awning. This is achieved in that at least one, in particular, at least one multi-part bracing or clamping means (III, IV) is provided which can be inserted, in particular slid, into at least one of the brackets or shoulders (II) and which acts in particular radially with regard to the brackets or shoulders (II). The bracing or clamping means (III, IV) can be twisted with regard to the associated bracket or shoulder (II) about its longitudinal axis (12), at least to a limited degree, and receives the joint pin (I) in a positive- or nonpositive-locking manner. Alternatively or additionally it is proposed that at least one height adjustment and/or tilt adjustment means and at least one twisting means of the associated joint pin (I), which twisting means is continuously adjustable about its longitudinal axis, are arranged coaxial to each other in the bracket (II).

16 Claims, 7 Drawing Sheets

(56) References Cited

U.S. PATENT DOCUMENTS 5,307,856 A * 5/1994 Murray ..... 160/70
5,836,210 A * 11/1998 Lohausen ..... 74/483 K
6,446,917 B2 * 9/2002 Dieckmann et al. ..... 248/74.4
2007/0193700 A1 * 8/2007 Ornelas et al. ..... 160/70
2012/0273144 A1 * 11/2012 Llagostera Forns ..... 160/368.1
2013/0126104 A1 * 5/2013 Weber ..... 160/79

* cited by examiner

SELF-SUPPORTING ARTICULATED-ARM CASSETTE AWNING FOR VEHICLES

This U.S. NON-Provisional Application claims priority under 35 U.S.C. §119 to German Patent Application filing number 20 2012 012 282.7, filed Dec. 24, 2012, which is hereby incorporated by reference.

FIELD OF THE INVENTION

The invention relates to a self-supporting articulated-arm cassette awning, in particular for motorhomes or trailers, comprising articulated arms that can be pivoted at awning arms joints or shoulder joints. Accordingly, the entire awning is provided with brackets (shoulders) which are connected to the vehicle by means of fastening elements. The brackets or shoulders are provided for slideably receiving the joint pin and for at least limiting the twistability of the joint pin of that part of an awning arm joint or shoulder joint that is fixed to the vehicle. The invention further relates to a device for receiving the articulated arms of a self-supporting articulated-arm cassette awning, thus an awning without support legs.

TECHNOLOGICAL BACKGROUND

In the caravan and mobile home industry, self-supporting articulated-arm cassette awnings (hereinafter also designated as awnings or cassette awnings) are known as a relatively new trend. Compared to conventional awnings in this field of use, which have support legs, the awning arm joints and therefore also the joint pins have to absorb the entire load, in particular torques. Thus, a particularly stable solution is required. The solutions currently available on the market enable only fixed inclination angles of the extended awning of optionally 5° or 15°, but no intermediate position. Also, due to the different installation heights on the side wall of the motor home or the caravan or the roof, an adjustable inclination angle would be advantageous. Another problem is that due to manufacturing tolerances in the production, a certain percentage of the awnings do not have a perfectly horizontal front rail in the extended state, which can result in customer complaints. Also, due to the different installation heights on the side wall of the motor home or the caravan or the roof, an adjustable inclination angle would be advantageous.

A continuously adjustable device would eliminate this problem since in this manner, each arm can be adjusted individually. This device is designated hereinafter as shoulder.

In addition to the inclination angle, the angle and the height of the arm when folding and retracting into the housing during the closing process should also be adjustable. The correct horizontal position is required so as to avoid a collision with the fabric roller in the case of an arm that is set too high (FIG. 6*c*), and to avoid contact with the housing bottom in the case of an arm that is set too low. This adjustment is required or at least desirable in order to ensure smooth closing. Due to production tolerances and normal play, this position can vary; however, it can also change due to wear throughout the service life. Therefore, a solution is required which enables a simple adjustment also in the case of service at a later time.

Shoulder joints of articulated-arm cassette awnings with inclination adjustment which are currently typically used on the market are based on the principle of tooth segments for defining two fixed inclination angles. In addition, height correction of the awning arms can be achieved in the closed position thereof by means of oblong holes. In the case of awnings for stationary use, inclination adjustment of the extended awning is carried out via oblong holes in connection with a pin joint.

From EP 1 215 348 B1 it is known to use for articulated-arm awnings two tubular brackets for mounting the fabric shaft, each of which tubular brackets receive in their cylindrical cavity, which serves as shaft bearing receptacle, an insertable bearing journal which is twistable to a limited degree and has a cam as a twist limit stop. An adjusting screw adjustably mounted in the joint pin receptacle serves as a counter stop. The respective awning arm joint is located laterally spaced from the fabric shaft bearing and is mounted separately on an articulated-arm bracket.

Apart from the inclination angle, if possible, the angle and the height of the arm should also be adjustable for folding and retracting into the housing during the closing process. The correct horizontal position is required so as to avoid a collision with the fabric roller in the case of an arm that is set too high, and to avoid contact with the cassette housing bottom in the case of an arm that is set too low. This adjustment is required in order to ensure smooth closing. Due to production tolerances and normal play, this position can vary; however, it can also change due to wear throughout the service life. Therefore, a solution is desirable which also enables a simple adjustment in the case of service at a later time.

The above-mentioned tilt angle adjustment of the joint pin is subject matter of EP 1 760 221 B1. Here, a positive-locking joint pin receptacle with tilt angle adjustment of the pin by means of an adjusting screw and a tilting bearing is proposed.

A continuously variable adjustability of the awning arms that takes into account the torques to be expected on vehicles in the case of a self-supporting articulated-arm cassette awning, in particular if said adjustability would be combined with height adjustability, i.e., tilt adjustability of the awning arms, would eliminate the aforementioned problems. Each individual awning arm would be adjustable in multiple axes and without steps. The support elements relevant for the aforementioned purposes are also designated hereinafter as shoulder(s).

SUMMARY

In order to be able to compensate, among other things, production tolerances of awning holders in the caravan sector as well as different installation conditions for self-supporting articulated-arm cassette awnings, a continuously variable inclination adjustment of a stable design is to be implemented. Furthermore, it is desirable to align the articulated arms in such a manner that neither the awning fabric nor the fabric struts to be extended rub in an undesirable manner against the housing on the vehicle. For solving the first-mentioned problem, the invention proposes a self-supporting articulated-arm cassette awning. Accordingly, a generic self-supporting articulated-arm cassette awning is provided in the case of which the torques occurring when the awning is completely or partially extended are transmitted to the brackets or shoulders in that at least one, in particular, at least one multi-part bracing or clamping means is provided which can be inserted, in particular slid, into at least one of the brackets or shoulders and which acts in particular radially with regard to the brackets or shoulders. The bracing or clamping means can be twisted with regard to the associated bracket or shoulder about its longitudinal axis, at least to a limited degree. The bracing or clamping means can receive the joint pin in a positive-locking or nonpositive-locking manner. The invention is based on the basic concept of providing a clamping and/or bracing means in the region of the joint pin for transmitting the torque to the awning bracket.

Another solution concept for a generic self-supporting articulated-arm cassette awning provides to coaxially integrate the height adjustment of the articulated arms and the continuously variable inclination adjustment into the articulated arm receptacle of the bracket. This can be carried out in that at least one height adjustment and/or tilt adjustment means and at least one twisting means of the associated joint pin, which twisting means is continuously adjustable about its longitudinal axis, are arranged coaxial to each other in the bracket. In particular, it can be provided that the joint pin, which is twistable about its longitudinal axis, in particular to a limited degree, is arranged in a sleeve-like bracing or clamping means in a positive-locking manner, and is transversely displaceable and/or tiltable with regard to its longitudinal axis.

The solution described here is easier, more compact and more cost-effective than the known solutions. Furthermore, it can be integrated in existing awnings through a simple exchange. The right and left shoulders consist of identical components. A continuously adjustable inclination angle facilitates, among other things, adjustment of the awning during production and installation.

There are different ways of carrying out the invention, as will be apparent from the following description and the dependent claims.

The aforementioned and claimed components as well as the components described in the exemplary embodiments and to be used according to the invention are not subject to any particular exceptions in terms of their size, shape, material selection and technical concept so that the selection criteria known in the field of use are applicable without restrictions.

Further details, features and advantages of the subject matter of the invention arise from the sub-claims and the following description and the associated drawing in which—by way of example—an exemplary embodiment of a self-supporting articulated-arm cassette awning is illustrated. Also, individual features of the claims or the embodiments can be combined with other features of other claims and embodiments.

BRIEF DESCRIPTION OF THE FIGURES

In the FIGS. 1 to 9, different embodiments of a self-supporting articulated-arm cassette awning are shown. In the figures:

FIG. 3*a* shows the cross-section A-A of the shoulder according to FIG. 3 with adjustment and fixation of the joint pin;

FIG. 3*b* shows the cross-section B-B of the shoulder according to FIG. 3 with a threaded pin for clamping tension;

FIG. 3*c* shows the cross-section C-C of the shoulder according to FIG. 3 with an angle set to 5°;

FIG. 3*d* shows the cross-section C-C of the shoulder according to FIG. 3 with an angle set to 15°;

FIG. 3*e* shows the cross-section C-C of the shoulder according to FIG. 3 with an intermediate angle being set;

FIG. 4*a* shows the longitudinal section D-D of the shoulder according to FIG. 4 with the pin in a neutral position;

FIG. 4*b* shows the longitudinal section D-D of the shoulder according to FIG. 4 with the pin in an increased angular position;

FIG. 4*c* shows the longitudinal section D-D of the shoulder according to FIG. 4 with the pin in a reduced angular position;

FIG. 4*d* shows the longitudinal section D-D of the shoulder according to FIG. 4 with the pin in a raised position;

FIG. 4*e* shows the longitudinal section D-D of the shoulder according to FIG. 4 with the pin in a lowered position;

FIG. 7 shows an alternative embodiment for a roof-mounted awning, wherein FIG. 7*a* shows a version for the right side and FIG. 7*b* shows a version for the left side;

DETAILED DESCRIPTION OF EXEMPLARY EMBODIMENTS

Figure 1:
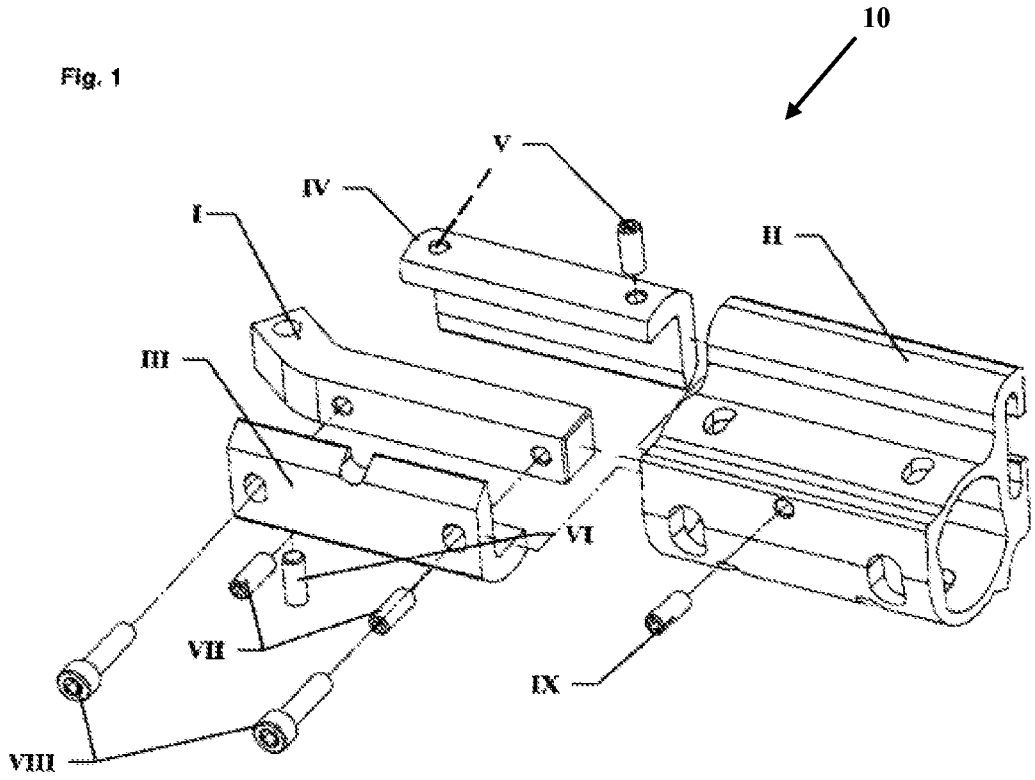
FIG. 1 shows an exploded view of the continuously adjustable shoulder.
Figure 3:
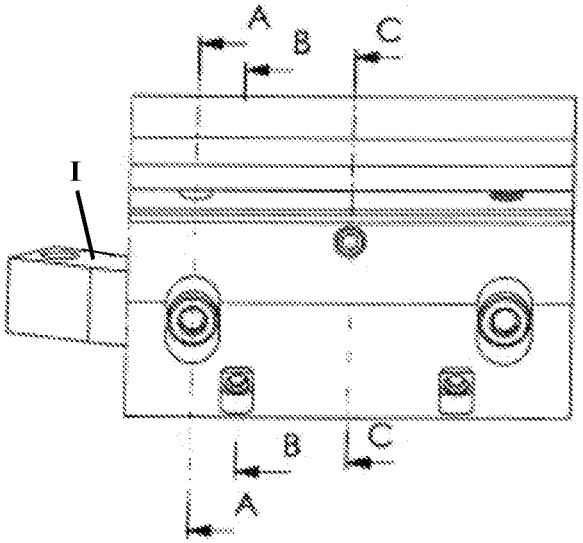
FIG. 3 shows a side view of the right shoulder according to FIG. 2*a*, with sectional views of a continuously adjustable shoulder.
Figure 3:
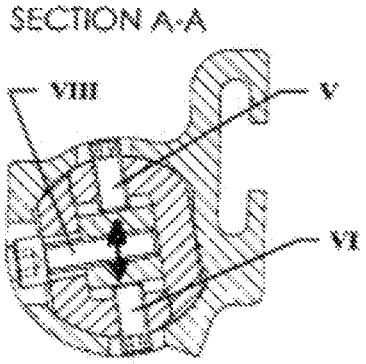
Figure 3:
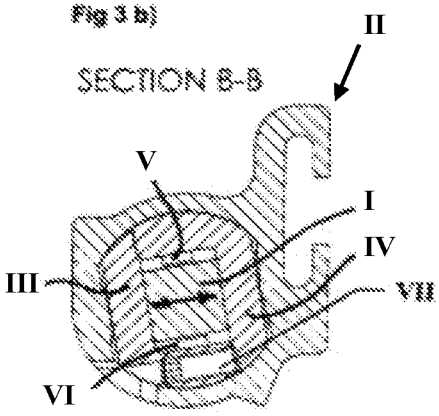
Figure 3:
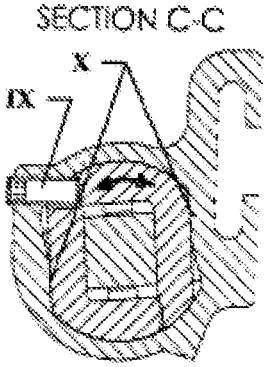
Figure 3:
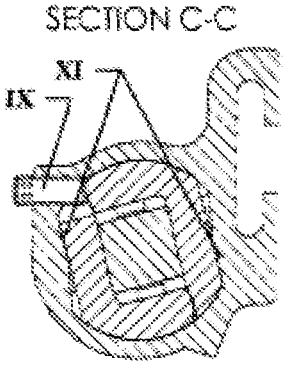
Figure 3:
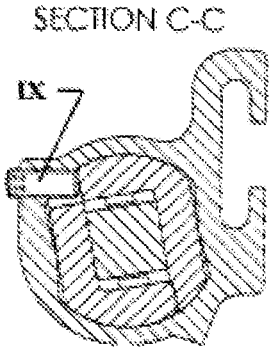
Figure 4:
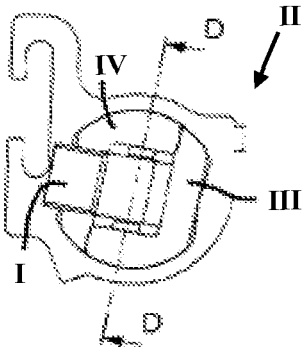
FIG. 4 shows a view of the left end face of the right shoulder according to FIGS. 2*a* and 3 with a cross-sectional view with regard to the adjustment of the joint pin.
Figure 4:
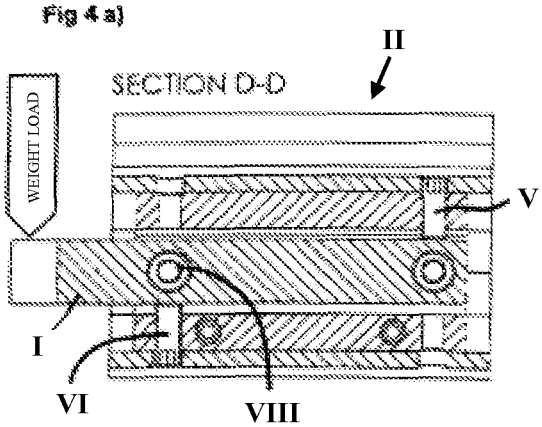
Figure 4:
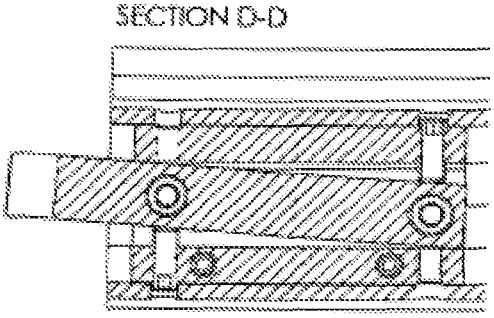
Figure 4:
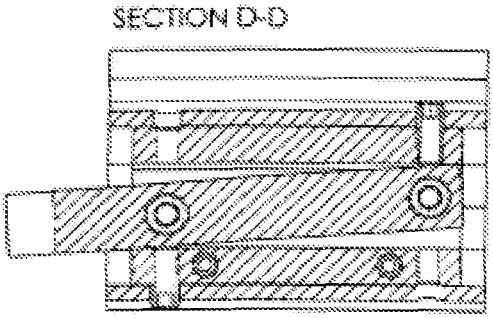
Figure 4:
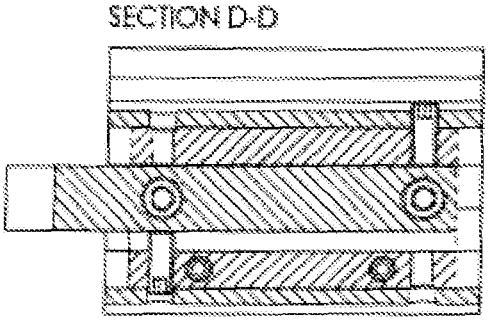
Figure 4:
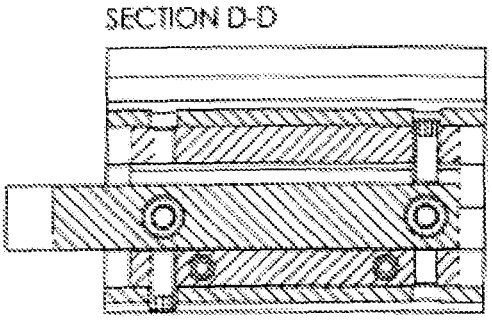
Figure 5:
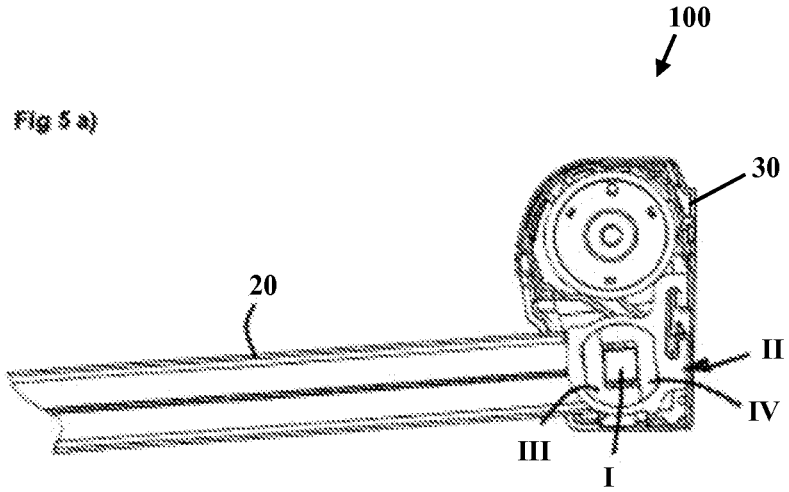
FIG. 5*a* shows a view of the end face of an articulated-arm cassette awning with a shoulder according to the FIGS. 1 to 4, with an inclination angle of the shoulder set to 5°.
FIG. 5*b* shows a view of the end face of the same articulated-arm cassette awning with a shoulder according to the FIGS. 1 to 4, with an inclination angle of the shoulder set to 15°.
FIG. 5*c* shows a view of the end face of the same articulated-arm cassette awning with a shoulder according to the FIGS. 1 to 4, with a user-defined inclination angle of the shoulder.
Figure 5:
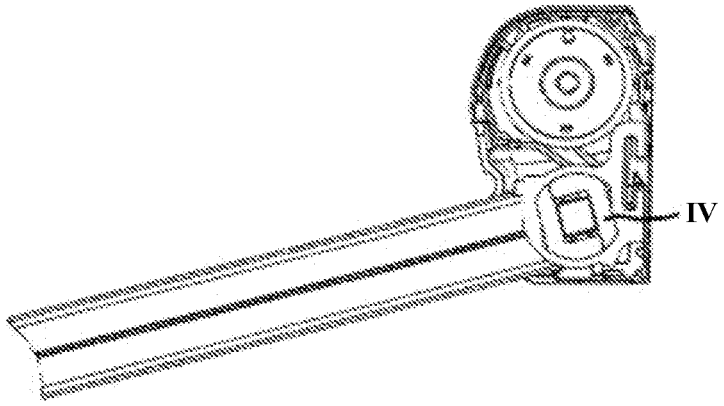
Figure 5:
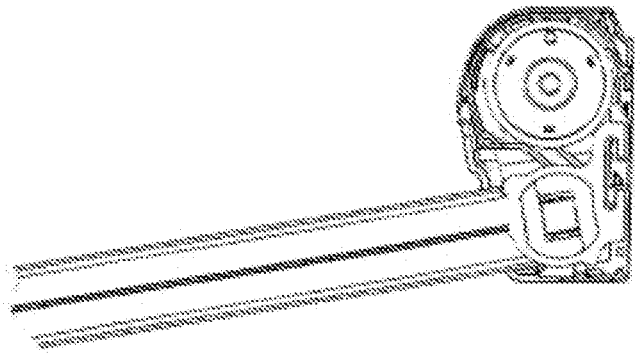
Figure 6:
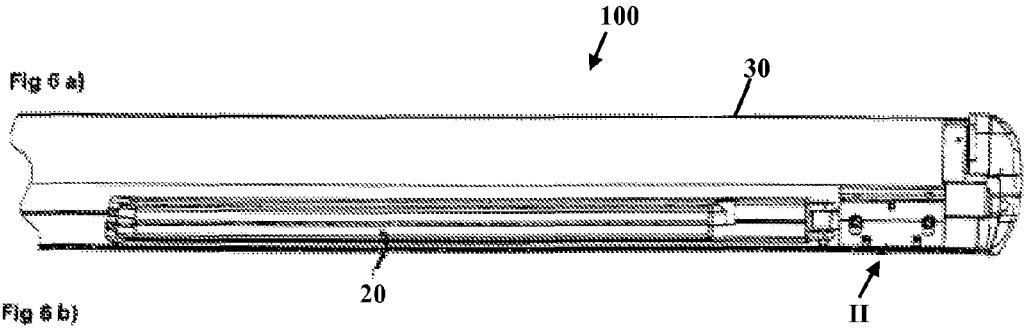
FIG. 6*a* shows a front view of the same articulated-arm cassette awning with a shoulder according to the FIGS. 1 to 4, with the correct height and angular position of the articulated arm.
FIG. 6*b* shows a front view of the same articulated-arm cassette awning with a shoulder according to the FIGS. 1 to 4, with a low-hanging articulated arm and in collision with the housing bottom.
FIG. 6*c* shows a front view of the same articulated-arm cassette awning with a shoulder according to the FIGS. 1 to 4, with an elevated articulated arm in collision with the fabric shaft.
Figure 6:
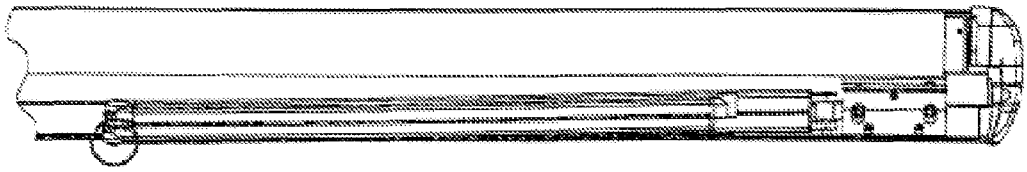
Figure 6:
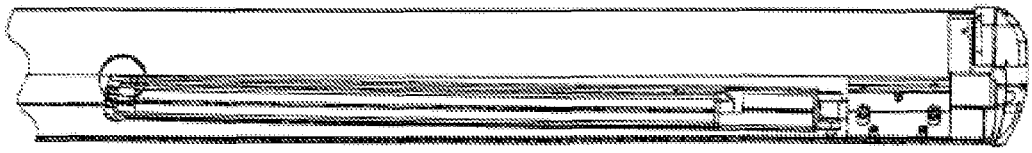

All exemplary embodiments have in common that a shoulder joint 10 has a bracket or shoulder II (FIG. 1) which serves as a receptacle and is fastened to the backside of the awning 100 (FIGS. 5*a* to 5*c*). A front clamping piece III and a rear clamping piece IV, which are arranged inside the bracket or shoulder II to be twistable within in a limited angular range about their longitudinal extent, receive between each other a joint pin I of a shoulder or awning arm joint 10 (FIGS. 5, 6), which joint pin is fastened to said clamping pieces and has a first joint part Ia connected thereto. For this purpose, as known per se, the shoulder or bracket is hollow inside, in particular in a tubular manner. An awning arm 20 is pivotably fastened to the first joint part Ia. The joint pin I can be adjusted in terms of its height and its tilt or inclination angle (FIGS. 4*a* to 4*e*) so as to ensure a correct position of the awning arm 20 in the awning housing 30 when closing the awning. Two threaded pins V and VI, which work against the weight force of the arm, define the height and tilt position of the joint pin within the clamping pieces III and IV. Two cylinder head screws VIII fix the joint pin I to the front clamping piece III (FIG. 3*a*). If, e.g., the weight force of the awning arms 20 is not sufficient, it is also possible to use four threaded pins V and VI instead of two threaded pins V and VI.

The inclination angle of the extended awning arm or articulated arm 20 is adjusted by twisting the joint pin I and the clamping pieces III and IV about the common longitudinal axis 12 of the two clamping pieces III and IV by means of a further threaded pin IX. The further threaded pin IX, which in the illustrated and, in this respect, exemplary embodiment is screwed into the upper region of the shoulder or bracket II, presses against the rear clamping piece IV. Through this, twisting of the clamping pieces III and IV about their longitudinal axis 12 is achieved. After completed adjustment of the desired angle, the two clamping pieces III and IV are then fixed in their adjusted twist or inclination angle position (FIG. 3*b*). In the illustrated and, in this respect, exemplary embodiment, this is carried out via two threaded pins VII (FIG. 3*b*) which are screwed into the front clamping piece III and which generate a clamping/bracing effect on the two clamping pieces by means of a radially outwardly acting circumferential tension within the shoulder or the bracket II. In this manner, potential gaps, in particular radial gaps, and virtually any play of the joint pin I within the shoulder or bracket II is eliminated.

The adjustment range is limited by in each case two limit stops X (FIG. 3*c*) and XI (FIG. 3*c*) in the shoulder or bracket, which prevent an adjustment <5° and >15°, respectively. This increases safety for the user in the event of extreme weather conditions.

Figure 2:
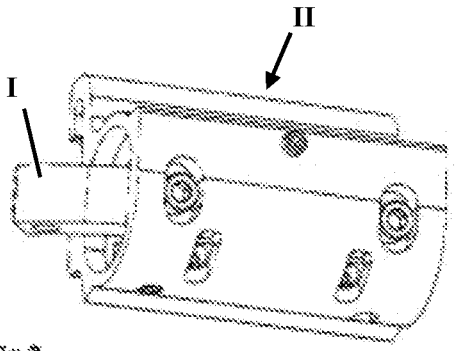
FIG. 2*a* shows the right shoulder in the assembled state.
FIG. 2*b* shows the left shoulder in the assembled state.
Figure 2:
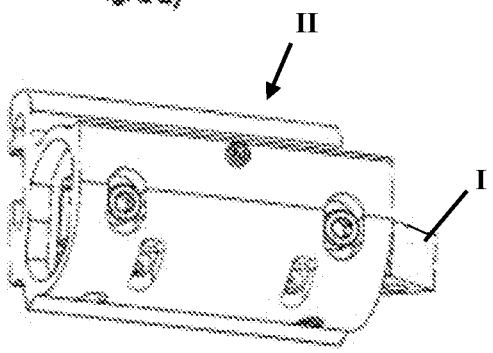

Another advantage of this construction is that a right (FIG. 2*a*) and a left version (FIG. 2*b*) comprise the exact same components; however, the joint pin I is inserted from the other (the opposite) side into the shoulder or bracket. This simplifies preassembly and the spare part business and reduces costs.

Figure 7:
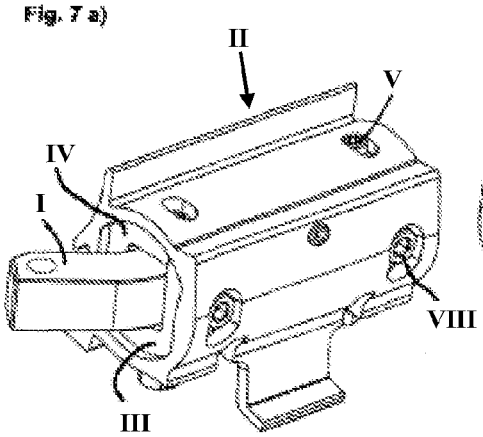
Figure 7:
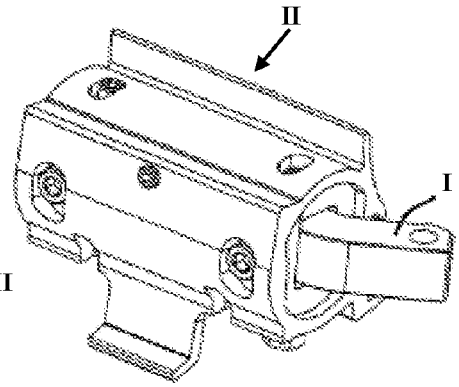
Figure 8:
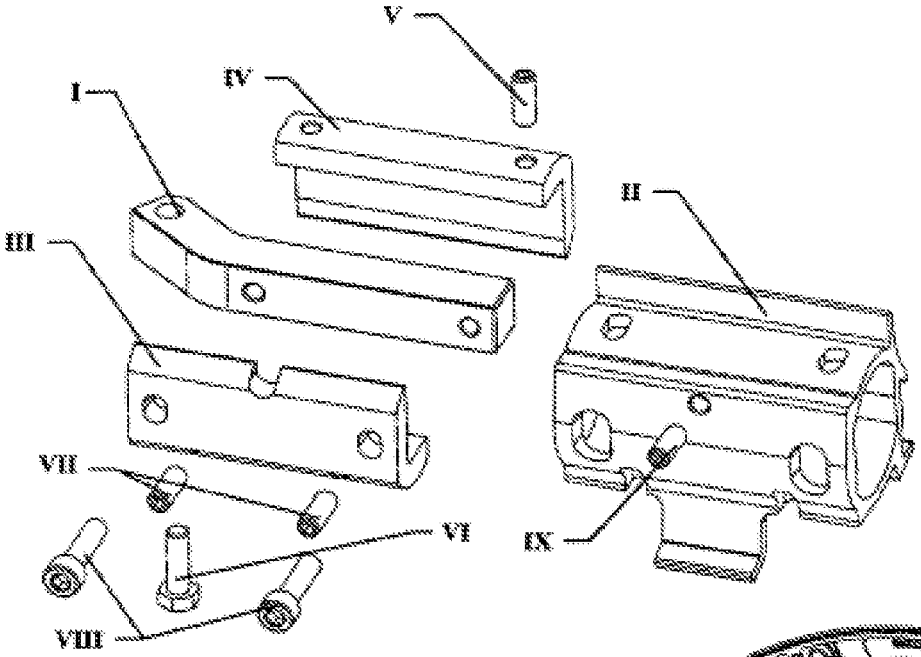
FIG. 8 shows an exploded view of the embodiment for roof-mounted awnings.
Figure 9:
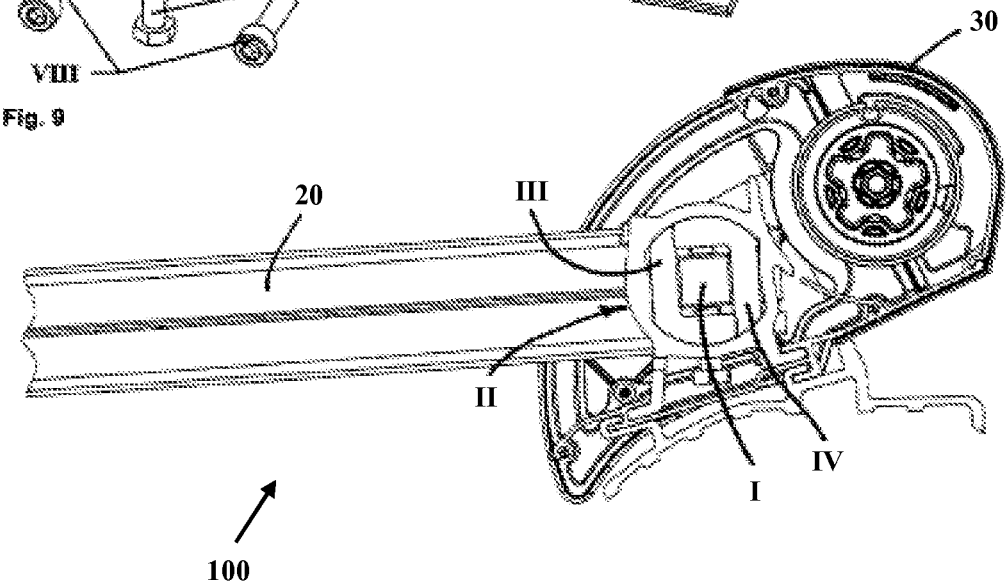
FIG. 9 shows an alternative embodiment in the housing of the roof-mounted awning.

The above-described construction is designed for the use of a wall-mounted awning. The same concept can also be adapted for other awnings. As another example of use (FIGS. 7*a*), *b*) & *c*)), an adaption for a roof-mounted awning is illustrated. In contrast to the wall-mounted awning, this type of awning is mounted on the vehicle roof. In the case of this design, the fabric shaft is arranged in the housing behind the arms instead of above. FIG. 8 shows the structure of this embodiment, wherein the shoulder joint substantially consists of the same components as the shoulder joint for the wall-mounted awning; the receptacle (FIG. 8 I), however, is adapted for the other housing design. FIG. 9 shows a view of the roof-mounted awning in which the installed shoulder can be seen.

REFERENCE LIST

100 Awning
10 Shoulder joint (or awning arm joint)
12 Longitudinal axis
20 Awning arm or articulated arm
30 Awning housing
I Joint pin
II Shoulder (or bracket)
III Front clamping piece
IV Rear clamping piece
V Threaded pins
VI Threaded pins
VII Threaded pins
VIII Cylinder head screws
IX Threaded pin
X Limit stops
XI Limit stops Explanation:

I. Joint pin: Device for receiving the arm of the awning.

II. Bracket or receptacle: Fastened to the awning housing, receives components of the shoulder joint.

III. Front clamping piece: Connects the joint pin to the receptacle, includes the cylinder head screws (VIII) and the threaded pins (VII).

IV. Rear clamping piece: Connects the joint pin to the receptacle.

V. Upper threaded pins: Define height and angle of the joint pin.

VI. Lower threaded pins: Define height and angle of the joint pin.

VII. Threaded pins for fixing the angle: Generate clamping tension.

VIII. Cylinder head screws for fastening the joint pin to the front clamping piece.

IX. Threaded pin for adjusting the inclination angle of the articulated arms and the twist position of the joint pins.

The invention claimed is:

1. A self-supporting articulated-arm cassette awning for motor homes or trailers comprising: at least two awning arm joints, each of said awning arm joints having a bracket, a multi-part bracing and a joint pin; an articulated arm that is pivotable at the awning arm joint; said bracket slidably receiving the joint pin and limiting the twistability of the joint pin; wherein torques occurring when the awning is at least partially extended are transmitted to the bracket; wherein the multi-part bracing is slidably inserted into the bracket, the multi-part bracing acting radially with regard to the bracket; further wherein the bracing can be pivoted with regard to the bracket about a longitudinal axis of the bracket, at least to a limited degree, and the joint pin is received by the bracing in a positive- or nonpositive-locking manner; wherein the bracing comprises two clamping pieces, and in an assembled state the two clamping pieces substantially surround the joint pin preventing direct contact between the joint pin and the bracket.

2. The self-supporting articulated-arm cassette awning according to claim 1, wherein said joint pin further comprises at least one of a height adjustment or a tilt adjustment, and at least one twisting adjustment, said joint pin and said bracing being arranged coaxial to each other in the bracket.

3. The self-supporting articulated-arm cassette awning according to claim 1, characterized in that the joint pins, which are twistable, to a limited degree, about a longitudinal axis are arranged in said bracing in a positive-locking manner, and said joint pins are at least one of transversely displaceable or tiltable with regard to the longitudinal axis.

4. The self-supporting articulated-arm cassette awning according to claim 1, characterized in that at least one of the clamping pieces comprises an angled profile.

5. The self-supporting articulated-arm cassette awning according to claim 1, characterized in that said joint pin can be fixedly connected to the bracing in an adjusted position by a connector.

6. The self-supporting articulated-arm cassette awning according to claim 1, characterized in that at least one of the clamping pieces of the multi-part bracing can be displaced into a desired twist angle position by at least one adjusting element.

7. The self-supporting articulated-arm cassette awning according to claim 6, characterized in that the at least one adjusting element is an adjusting screw that is rotatably supported on the bracket.

8. The self-supporting articulated-arm cassette awning according to claim 1, characterized in that the bracket has at least one fixed limit stop for at least one of the clamping pieces of the multi-part bracing for defining a limit angle.

9. The self-supporting articulated-arm cassette awning according to claim 8, characterized in that the limit stop inside the bracket ensures twisting of the at least one bracing about an axis of twist.

10. The self-supporting articulated-arm cassette awning according to claim 1, characterized in that one of the clamping pieces of the multi-part bracing can be braced with regard to the other clamping piece of the multi-part bracing by at least one adjusting element.

11. The self-supporting articulated-arm cassette awning according to claim 10, characterized in that the at least one adjusting element is an adjusting screw that is rotatably supported on the bracing.

12. A self-supporting articulated-arm cassette awning for motor homes or trailers, comprising: at least two awning arm joints, each of said awning arm joints having a bracket, a multi-part bracing and a joint pin; an articulated arm that is pivotable at the awning arm joint; said bracket connecting the awning to the motor homes or trailers by fastening elements, said bracket receiving the joint pin in a slidably insertable manner, and limiting the twistability of the joint pin; the joint pin being inserted within said bracing, said bracing and said joint pin inserted together into said bracket; wherein at least one of said bracing and said bracket further comprises at least one of a height adjustment or a tilt adjustment of the joint pin, and at least one twisting adjustment; the joint pin and said bracing being adjustable about a longitudinal axis and arranged coaxial to each other in the bracket; wherein the bracing comprises two clamping pieces, and in an assembled state the two clamping pieces substantially surround said joint pin and prevent the joint pin from directly contacting the bracket.

13. The self-supporting articulated-arm cassette awning according to claim 12, characterized in that the joint pin is twistable to a limited degree, about the longitudinal axis, is arranged in said bracing in a positive-locking manner, and is at least one of transversely displaceable or tiltable with regard to the longitudinal axis.

14. The self-supporting articulated-arm cassette awning according to claim 12, characterized in that said joint pin can be fixedly connected to the bracing in an adjusted position by a connector.

15. The self-supporting articulated-arm cassette awning according to claim 12, characterized in that the bracing can be displaced into a desired twist angle position by at least one adjusting element.

16. The self-supporting articulated-arm cassette awning according to claim 12, characterized in that the bracket has at least one fixed limit stop therein, the fixed limit stop defining a limit angle.

* * * * *